US011142450B2

(12) United States Patent
Maloigne

(10) Patent No.: US 11,142,450 B2
(45) **Date of Patent: *Oct. 12, 2021**

(54) STIRRUP FOR HORSE-RIDING

(71) Applicant: Philippe Maloigne, Sauqueuse Saint Lucien (FR)

(72) Inventor: Philippe Maloigne, Sauqueuse Saint Lucien (FR)

( * ) Notice: Subject to any disclaimer, the term of this patent is extended or adjusted under 35 U.S.C. 154(b) by 242 days.

This patent is subject to a terminal disclaimer.

(21) Appl. No.: 16/257,513

(22) Filed: Jan. 25, 2019

(65) Prior Publication Data

US 2019/0241424 A1 Aug. 8, 2019

(30) Foreign Application Priority Data

Feb. 2, 2018 (FR) ..... 1850889

(51) Int. Cl.
*B68C 3/02* (2006.01)
*B68C 3/00* (2006.01)

(52) U.S. Cl.
CPC ..... *B68C 3/02* (2013.01); *B68C 2003/005* (2013.01); *B68C 2003/0033* (2013.01); *B68C 2003/0083* (2013.01)

(58) Field of Classification Search
CPC ..... B68C 3/02; B68C 2003/0033; B68C 2003/005; B68C 2003/0058
See application file for complete search history.

(56) References Cited

U.S. PATENT DOCUMENTS 223,690 A * 1/1880 Adel ..... B68C 3/02 54/49
259,101 A 8/1882 Cox
478,633 A * 7/1892 Peacock ..... B68C 3/0016 54/49
1,088,552 A * 2/1914 Dolan ..... B68C 3/02 54/49

(Continued)

FOREIGN PATENT DOCUMENTS

AU 8251575 A 1/1977
DE 202007017810 U1 3/2008

(Continued)

OTHER PUBLICATIONS

English translation of WO2006024711A1 (attached) (Year: 2006).*
French Search Report dated Sep. 20, 2018 in corresponding FR Application No. 1850889.

*Primary Examiner* — Peter M Poon
*Assistant Examiner* — Marisa V Conlon
(74) *Attorney, Agent, or Firm* — Harness, Dickey & Pierce, PLC

(57) ABSTRACT

A stirrup for horse-riding, including a tread of which a first end is connected by a first side branch to an upper portion of the stirrup adapted to receive a stirrup leather, and including a second side branch movable between a position for use in which the second side branch connects a second end portion of the tread to the upper portion and open positions in which the second side branch is distanced from the second end portion of the tread. The second side branch (Continued)

is connected to the upper portion by a swivel linkage and, in the position for use, the second side branch is secured to the second end portion of the tread by magnetic attraction.

17 Claims, 4 Drawing Sheets

(56) References Cited

U.S. PATENT DOCUMENTS

| | | | | |
|---|---|---|---|---|
| 3,910,015 | A * | 10/1975 | Ebejer | B68C 3/02 54/49 |
| 1,520,586 | A | 12/1992 | McCamis | |
| 6,330,781 | B1 * | 12/2001 | Meroth | B68C 3/025 54/49 |
| 7,065,943 | B2 * | 6/2006 | Chang | B68C 3/00 54/47 |
| 7,543,427 | B2 * | 6/2009 | Strauss | B68C 3/02 54/47 |
| 8,850,781 | B2 * | 10/2014 | Harvey | B68C 3/00 54/49 |
| 2005/0076620 | A1 * | 4/2005 | Sjosward | B68C 3/02 54/48 |
| 2005/0120684 | A1 | 6/2005 | Sparacino | |
| 2010/0300050 | A1 * | 12/2010 | Vollmecke | B68C 3/00 54/47 |
| 2015/0329350 | A1 * | 11/2015 | Bowe | B68C 3/00 54/47 |
| 2016/0194196 | A1 | 7/2016 | Ford | |
| 2017/0275151 | A1 | 9/2017 | Shano | |
| 2019/0144260 | A1 * | 5/2019 | Benetti | B68C 3/02 54/49 |

FOREIGN PATENT DOCUMENTS

| | | | | |
|---|---|---|---|---|
| EP | 3248935 | A1 | 11/2017 | |
| KR | 10-2010-0122288 | A | 11/2010 | |
| KR | 10-2010-0122289 | A | 11/2010 | |
| KR | 10-2013-0092126 | A | 8/2013 | |
| WO | WO2006024711 | * | 3/2006 | B68C 3/02 |
| WO | WO-2017/182942 | A1 | 10/2017 | |

* cited by examiner

STIRRUP FOR HORSE-RIDING

CROSS-REFERENCE TO RELATED APPLICATIONS

This application claims the benefit and priority of French Application No. 1850889 filed Feb. 2, 2018. The entire disclosure of the above application is incorporated herein by reference.

TECHNICAL FIELD

The present disclosure relates to a stirrup for the practice of horse-riding. In particular, the invention relates to a stirrup designed to increase the safety of the rider, reducing the risk of injury should the horse fall.

BACKGROUND

Riding saddles are generally equipped with two stirrups, carried by the saddle via leather straps called stirrup leathers. A stirrup generally comprises an eye for the passage of the stirrup leather, which is connected to a flat platform or tread supporting the sole of the rider's footwear, via one or two branches, which follow the sides of the rider's foot. A conventional stirrup having two branches thus surrounds the foot of the rider.

When a rider falls from his or her horse, it may happen that one of the rider's feet gets stuck in the stirrup. The horse may then drag the rider by the rider's foot, which can cause serious injury to the rider resulting from impact with the hooves of the horse or with surrounding obstacles.

Safety Stirrups

To limit the risk of the foot of the rider remaining stuck in the stirrup, stirrups known as safety stirrups exist which comprise a single branch between the portion surrounding the eye and a first end of the tread. To prevent the foot of the rider coming out of this open stirrup, an elastic ring is stretched between the portion surrounding the eye and the second end of the tread. On the occasion of a fall, if the foot of the rider does remain stuck in this stirrup, it normally exerts a pull on the elastic which causes it to break or get released, releasing the foot of the rider.

Such stirrups, which are commonly used by novice riders, are little used in the practice of competition riding, especially in races involving obstacles which can give rise to dangerous falls. Further, the presence of the elastic is detrimental to the aesthetics of the stirrup, limiting its acceptance. Moreover, it is common for elastic rings to break or get spontaneously unhooked, causing the rider significant discomfort and a risk of falling.

Safety Stirrups with an Articulated Branch

Other types of safety stirrup exist in which the platform or tread is connected to the eye via a fixed branch at one of the sides of the tread and via a movable branch at the other side of the tread. International application WO 2017/182 942 discloses such a stirrup, in which a movable branch is linked to the portion surrounding the eye of the stirrup by means of a hinge connection having an axis perpendicular to the plane in which the branches extend. In its position for use, the free end of this movable branch is held by a snap fastening arrangement at the free end of the tread. In the event of a fall resulting in the rider's foot getting jammed in the stirrup, the snap fastening holding the moving branch to the tread must open to release the foot. Nevertheless, it is apparent that a risk of jamming of the foot still exists, when the foot exerts a pressure on the movable branch of the stirrup in a direction substantially parallel to the axis of rotation. Moreover, there is also a risk of the free end of the movable branch becoming spontaneously disengaged from the tread, which is bothersome to the rider.

Aims

The present invention aims to overcome these disadvantages of the prior art. In particular, the present invention aims to provide a safety stirrup for the practice of horse-riding, which reliably ensures the release of the rider's foot when the rider falls from his mount. Another aim of the invention is to provide such a stirrup which, during normal use, ensures effective maintenance of the rider's foot without inadvertent opening of one of its branches. Yet another aim of the invention is to provide such a stirrup which can have an aesthetic appearance close to that of conventional stirrups.

SUMMARY

These aims, as well as others that will appear more clearly later, are achieved with a stirrup for the practice of horse-riding comprising a tread a first end of which is connected by a first side branch to an upper portion adapted to receive a stirrup leather, the stirrup comprising a second side branch movable between:

- a position for use, in which said second side branch connects a second end portion of said tread to said upper portion,
- open positions, in which said second side branch is distanced from said second end portion of said tread, the second side branch being connected to the upper portion by a swivel linkage.

According to a preferred embodiment, in the position for use the second side branch is rendered integral with the second end portion of the tread by magnetic attraction. Thus, the second side branch can easily change over to an open position to release the foot of the rider regardless of the direction of pressure exerted on the second side branch by the rider's foot from inside the stirrup. Moreover, despite the many degrees of freedom of the second side branch, the second side branch can be effectively held in place by the magnetic attraction which, at the same time, ensures maintenance and correct positioning of the second side branch relative to the second end of the tread, while allowing separation in several directions.

According to a preferred embodiment, the swivel linkage is constituted by an elastic cord urging a surface of the upper portion and a surface of the second side branch towards each other. A swivel linkage of this type is easy to implement.

Advantageously, the surface of the upper portion and the surface of the second side branch have complementary shapes adapted to maintain the second side branch in the position for use, when these two surfaces are in contact. Thus, the swivel linkage itself contributes to the correct positioning of the second side branch in the position for use. This positioning action which is complementary to the magnetic attraction ensures good maintenance in the position for use of the second side branch despite its many degrees of freedom.

Advantageously, the surface of the second side branch has a centering stud, and the surface of the upper portion has a recess of complementary shape to that of the centering stud, the centering stud being introduced, in the position for use, into the recess. The centering stud advantageously has a triangular cross-section.

According to a preferred embodiment, the second end portion of the tread has a first magnet, and the second side branch has a second magnet, the first magnet and the second magnet being polarized so as to be rendered integral by magnetic attraction in the position for use of the second side branch. The attraction between the magnets ensures the maintenance of the second side branch in the position for use, and the centering of the magnets relative to each other ensures proper positioning of the second side branch. Moreover, the attraction between the magnets ensures the second side branch will return to its correct position for use, should said second side branch become located a short distance away from this desired position whatever direction it has moved away from its correct position for use. Preferably, the first magnet is integrated into a first contact surface of the second end portion of the tread, and the second magnet is integrated into a second contact surface of the second side branch, the first contact surface and the second contact surface having shapes that are complementary to one another.

Advantageously, the first contact surface and the second contact surface have shapes enabling the second contact surface to move relative to the first contact surface from the position for use in a plurality of directions. The complementary shapes of the contact surfaces can thus participate in the proper positioning of the second side branch, without hindering its opening when the foot of the rider exerts enough pressure from inside the stirrup, regardless of the direction of this pressure. The invention will be better understood on reading the following description of preferred embodiments, given as a simple figurative and nonlimiting example, accompanied by the drawings.

DETAILED DESCRIPTION OF EMBODIMENTS

Stirrup in its Configuration for Normal Use

Figure 1:
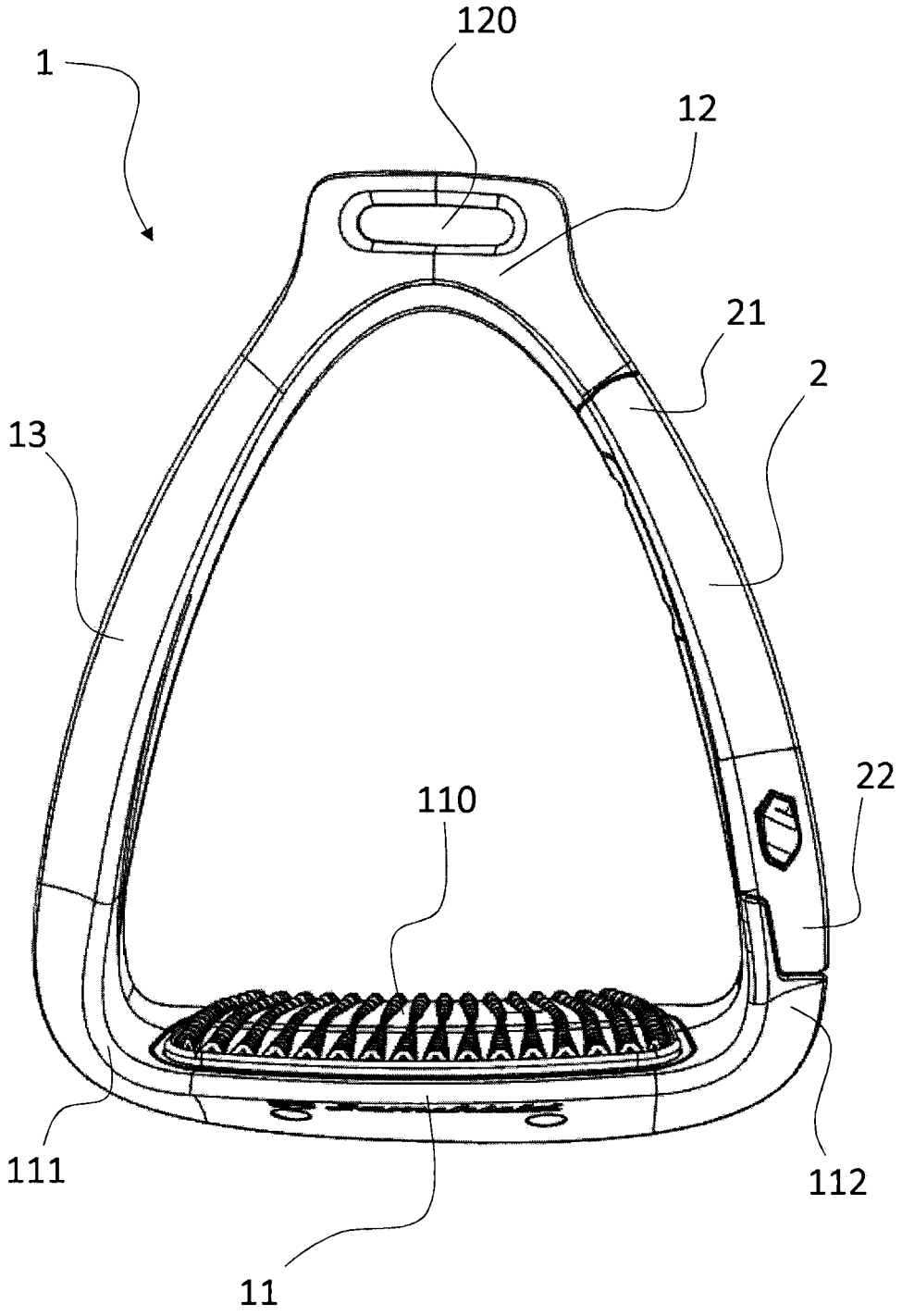
FIG. 1 shows, in front view, a stirrup according to one embodiment of the invention in its configuration when in use.
Figure 3:
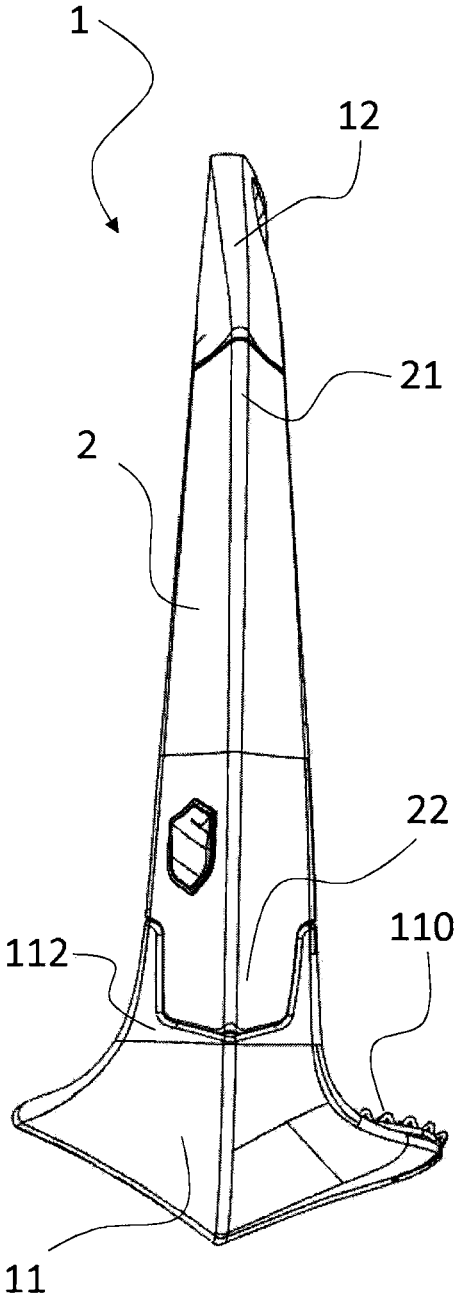
FIG. 3 is a side view of the stirrup of FIG. 1, in its configuration when in use.

FIGS. 1 and 3 show a stirrup 1 according to one embodiment of the invention. In FIG. 1, the stirrup 1 is shown in a front view, that is to say in the position said second side branch has when the rider who uses it normally is viewed from the front. In FIG. 3, the stirrup 1 is seen in a side view, in the position the second side branch has when looking at the left-hand side of the rider who uses the stirrup normally. It should be noted that this stirrup 1 is a left-hand side stirrup, so that FIG. 3 represents a view of its outer side. The following description of this stirrup can however also apply, mutatis mutandis, to a right-hand side stirrup.

By convention, in the present application, the "forward direction" is the direction of advancement of the horse during the normal use of the stirrup, "the rear direction" is the opposite direction, "the inward direction" is the direction directed towards the horse during the normal use of the stirrup, and the "outward direction" is the reverse direction. Moreover, the term "end" in this application refers to the portion of a component of the stirrup that is in the region of its extreme limit.

Stirrup 1 comprises a flattened horizontal branch forming a platform 11, which is intended to receive the sole of a rider's footwear. Platform 11 is advantageously covered on its upper face by a non-slip coating 110 forming tread 11. The latter is connected at its first end, or inner end 111, to a first side branch or inner side branch 13, and at its second end, or outer end portion 112, to a second side branch or outer side branch 2. The inner side branch 13 and the outer side branch 2 rise from the tread to an upper portion 12 of the stirrup where the upper extremities of the two side branches meet. An opening, called the eye 120, allows the passage of the stirrup leather (not shown), which is a leather strap attached to the saddle and carrying the stirrup.

The inner side branch 13 is intended, in use, to be placed at the side facing the horse of the foot of the rider. This inner side branch 13 is a fixed branch which rigidly connects the tread 11 to the upper portion 12 of the stirrup.

The outer side branch 2 is intended, in use, to be placed at the side directed away from the horse of the rider's foot. This outer side branch 2 is, according to the invention, a movable branch. In the configuration for use of stirrup 1, shown in FIGS. 1 and 3, this branch extends in its position for use, between the outer side end portion 112 of tread 11 and the upper portion 12. In this way the tread 11, the side branches 13 and 2 and the upper portion 12 form a ring in which the rider places his foot.

Advantageously, stirrup 1 can be made of aluminum. However, in this case, upper portion 12, inner side branch 13 and tread 11 are preferably reinforced by steel rods, giving them the necessary strength.

Stirrup in its Open Configuration

Figure 2:
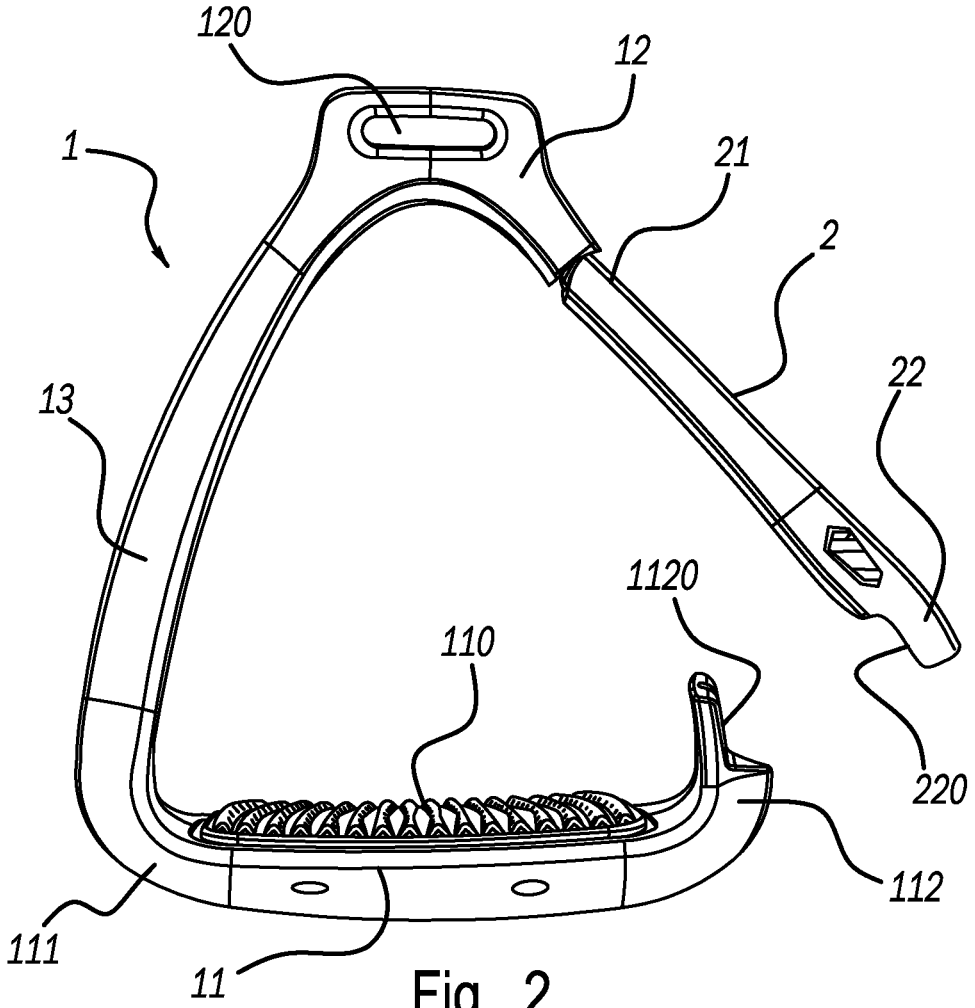
FIG. 2 shows, in a front view, the stirrup of FIG. 1, in an open configuration.
Figure 4:
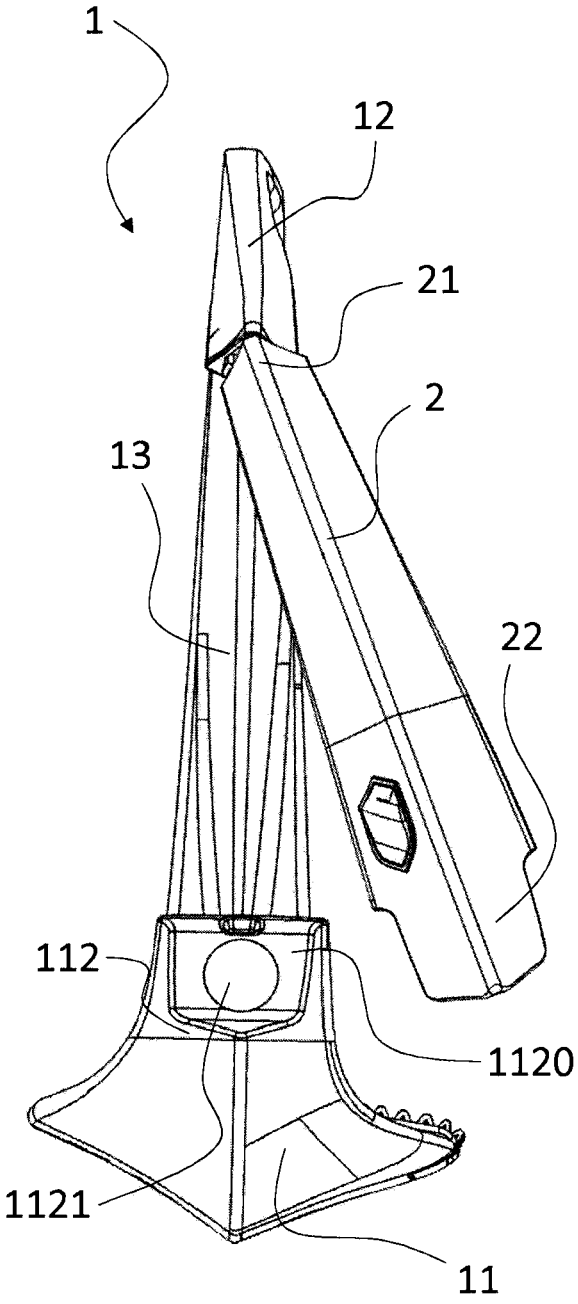
FIG. 4 is a side view of the stirrup of FIG. 1, in an open configuration.

FIGS. 2 and 4 show the same stirrup 1, respectively in front view and in side view, in its open configurations in which the outer side branch 2 is in its open position, distinct from its position for use shown by FIGS. 1 and 3. According to the solution of the invention, an upper end portion 23 of outer side branch 2 is connected to the upper portion 12 of the stirrup by a swivel linkage. This swivel linkage allows pivoting of the outer side branch 2 relative to upper portion 12 in any direction without being constrained by an axis of rotation.

Thus, when the foot of the rider exerts a sufficiently high pressure from inside the loop formed by the stirrup on the outer side branch 2, outer side branch 2 can pivot away from inner branch 13 as shown in FIG. 2, forwards as shown in FIG. 4, rearward or in any intermediate direction. This swivel linkage ensures effective release of the rider's foot in the event of a fall, regardless of the orientation of the pressure that the rider's foot exerts on outer side branch 2. It thus makes it possible to avoid the rider's foot becoming jammed which can cause serious accidents.

Holding the Stirrup in the Position for Use

The swivel linkage which gives many degrees of freedom to outer side branch 2, makes it somewhat difficult to maintain outer side branch 2 in its position for use shown in FIGS. 1 and 3, when using stirrup 1 normally. When stirrup 1 is in its configuration for use, outer side branch 2 must indeed be held in a sufficiently effective manner to prevent inadvertent movement in the various directions allowed by the pivoting swivel linkage. Retention must not however excessively hinder movement of outer side branch 2 relative to stirrup 1 when the foot of the user exerts pressure on outer side branch 2 from inside the stirrup, regardless of the direction of the pressure exerted.

To meet these conflicting requirements related to the implementation of the swivel linkage, stirrup 1 includes a positioning device for the lower end 22 of outer side branch 2 relative to the outer end portion 112 of tread 11 of the stirrup, the positioning device making use of magnetic attraction in order to render reversibly integral outer side branch 2 and the outer end portion of tread 11. The positioning device includes a first magnet 1121 integrated into the outer end portion 112 of tread 11 and adapted to cooperate with a second magnet 221 integrated into the lower end 22 of outer side branch 2.

Figure 5:
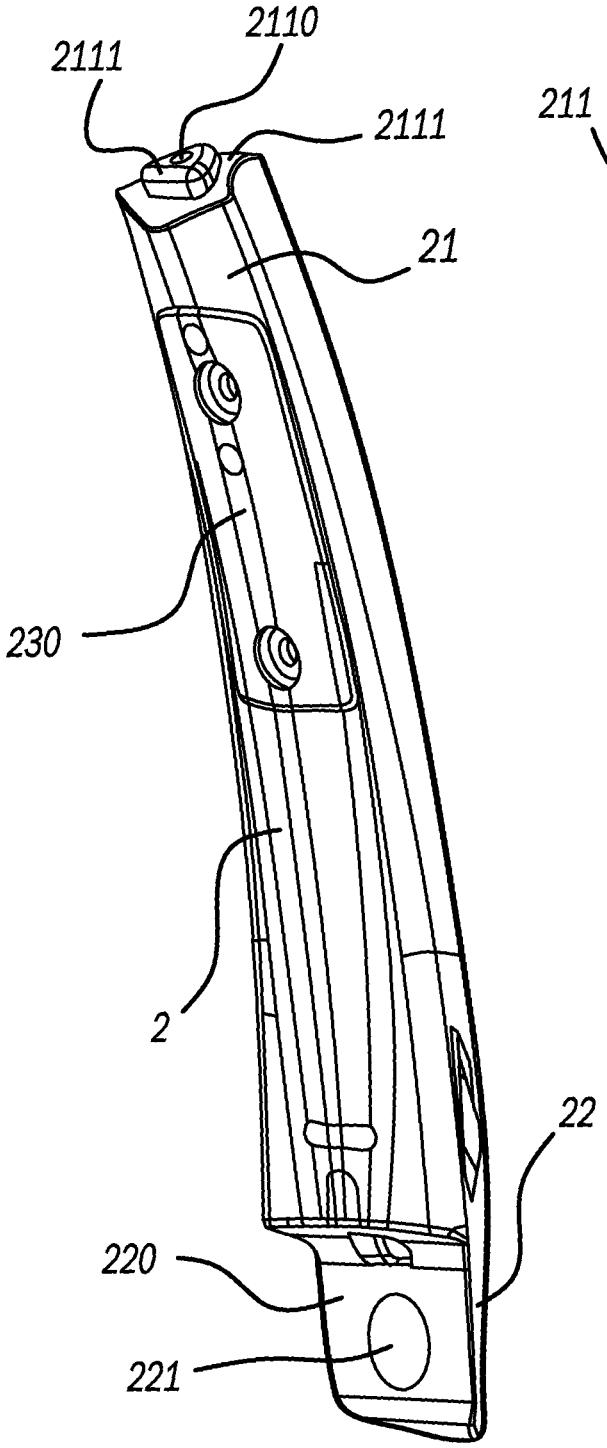
FIG. 5 shows the outer side branch of the stirrup of FIG. 1.

More specifically, the outer end portion 112 of tread 11 has a first contact surface 1120, particularly visible in FIG. 4, and the lower end 22 of outer side branch 2 has a second contact surface 220, particularly visible in FIG. 5. These two contact surfaces are intended to be in contact with each other in the configuration of use of stirrup 1 and have matching shapes such that they do not prevent either a movement of outer side branch 2 in the outward direction, nor in the forward direction nor in the rearward direction.

A first magnet 1121 is inserted and fixed in a housing provided for this purpose in a first contact surface 1120, and a second magnet 221 is inserted and fixed in a housing provided for this purpose in second contact surface 220. These two magnets advantageously have complementary polarities, to attract each other and to become centered relative to each other, in a position corresponding to the configuration of use of stirrup 1. The magnets 221 and 1121 thus ensure outer side branch 2 is held in its position for use and can also ensure return of outer side branch 2 to its position for use when the second side branch slightly shifts, whatever the direction of this shifting. Furthermore, the strength of these magnets 221 and 1121 is advantageously chosen to allow separation between outer side branch 2 and outer end portion 112 of tread 11, when pressure is exerted on outer side branch 2, whether this pressure is exerted in an outward direction, a forward direction or a rearward direction.

Embodiment of a Swivel Linkage

Figure 7:
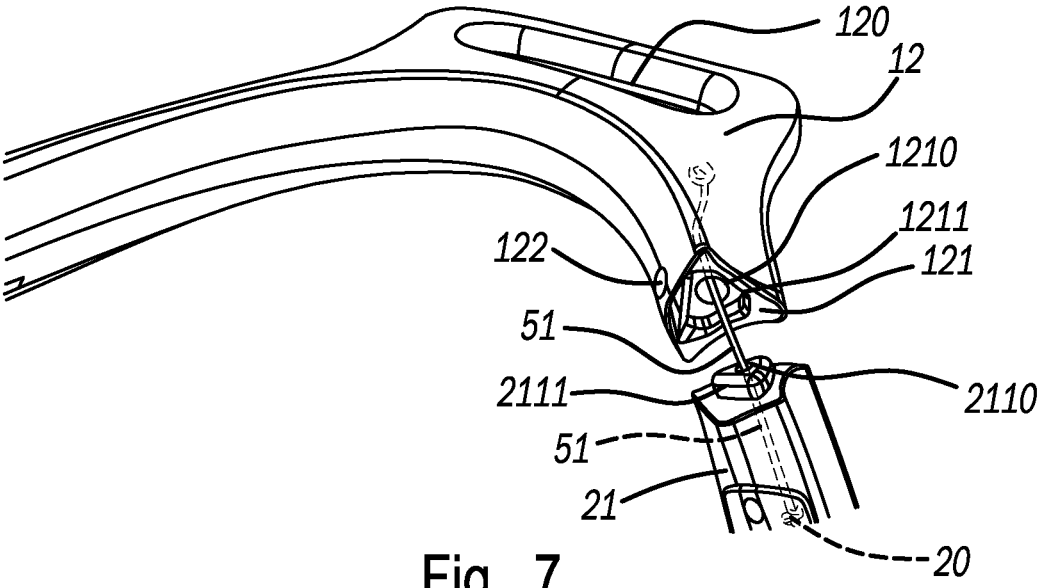
FIG. 7 is a detailed view of the upper portion of the stirrup of FIG. 1.
Figure 6:
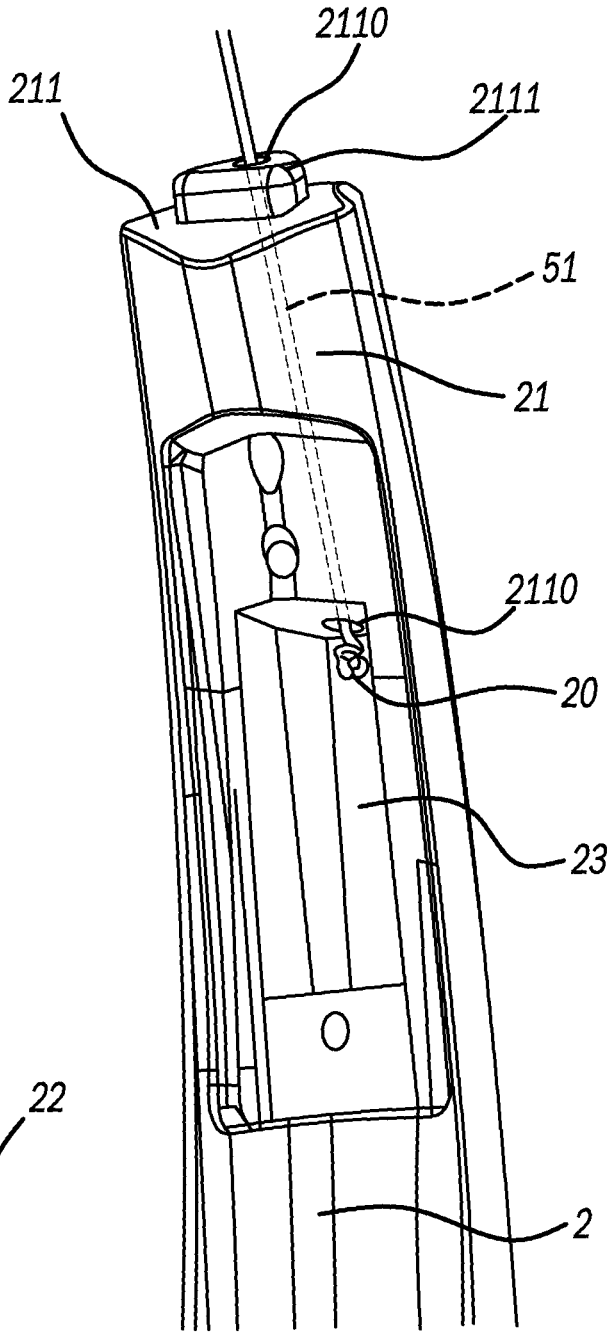
FIG. 6 is a detailed view of the outer side branch of FIG. 5, a shutter plate of which has been removed.

A swivel linkage between the upper end portion 21 of outer side branch 2 and upper portion 12 of stirrup 1 can be achieved by any means known to those skilled in the art. A particular embodiment implemented in stirrup 1 is described below, particularly in connection with FIGS. 5, 6 and 7.

The upper portion 12 of the stirrup has a surface 121 intended to be in contact with a matching surface 211 of an upper end 21 of outer side branch 2, in the position for use of this outer side branch 2. Surface 121 has a cylindrical blind hole 1210 formed in upper portion 12 of the stirrup. This hole 1210 is intended to receive a first end of an elastic cord 51 which can be locked in hole 1210 by tightening a screw 122 passing into hole 1210.

The surface 211 of upper end portion 21 of outer side branch 2 also has a cylindrical hole 2110 into which the second end of the elastic cord can be introduced. This hole 2110 opens into a compartment 23 provided in the body of outer side branch 2. The second end of the elastic cord, opening into this compartment 23 can be locked in position there, for example by means of a knot, after the elastic cord has been stretched to the desired tension. A cover 230 is then placed over compartment 23 to close and hide it. The elastic cord thus acts to bring the surfaces 121 and 211 closer while allowing them to move away under the effect of a force stretching the cord in order to allow angular movements of outer side branch 2.

Preferably, surface 211 has a centering stud 2111, through which hole 2110 passes, and surface 121 carries a recess 1211 in which a hole 1210 is drilled and which has a shape matching that of centering stud 2111. Stud 2111 and recess 1211 make it possible to ensure good positioning of the upper end portion 21 of outer side branch 2 with respect to upper portion 12, in the configuration of use of stirrup 1. In particular, stud 2111 and recess 1211 have non-circular cross-sections, here triangular, which force outer side branch 2 to a specific angular position, when in its position for use. It should be noted that stud 2111 and recess 1211 have dimensions and shapes such that they do not interfere with the rotational movements of outer side branch 2 relative to upper portion 12 of the stirrup when the outer side branch is moving to its open position leading to an elongation of the elastic cord.

The invention claimed is:

1. A stirrup for horse-riding comprising (a) a first side branch;

(b) a tread;

(c) an upper portion, a first end of said tread being connected by said first side branch to said upper portion which is adapted to receive a stirrup leather;

(d) a second side branch movable between:

(i) a position for use, in which said second side branch connects a second end portion of said tread to said upper portion; and (ii) open positions, in which said second side branch is distanced from said second end portion of said tread;

(e) an elastic cord urging a lower surface of said upper portion and an upper surface of said second side branch towards each other, said second side branch being connected to said upper portion by said elastic cord which internally spans therebetween; and (f) a centering stud having a non-circular cross-section and projecting in a substantially vertical direction from one of said upper or lower surfaces, wherein the other of said upper or lower surfaces has a recess of complementary non-circular shape to that of said centering stud; wherein the stirrup is configured so that in said position for use said elastic cord urges said centering stud into said recess.

2. The stirrup according to claim 1, wherein in said position for use, said second side branch is rendered integral with said second end portion of said tread by magnetic attraction.

3. The stirrup according to claim 1, wherein said complementary non-circular shaped centering stud and recess are adapted to maintain said second side branch in said position for use, when said surfaces are in contact.

4. The stirrup according to claim 1, wherein said upper portion and said surface of said second side branch have complementary shapes adapted to maintain said second side branch in said position for use, when said surfaces are in contact.

5. The stirrup according to claim 1, wherein said centering stud has a larger width than height and includes a central hole through which said elastic cord extends.

6. The stirrup according to claim 5, wherein said centering stud has a triangular cross-section.

7. The stirrup according to claim 1, wherein:

said second end portion of said tread includes a first magnet, and said second side branch includes a second magnet, said first magnet and said second magnet being polarized so as to be rendered integral by magnetic attraction in said position for use of said second side branch; and said second side branch has a lower end including a lateral step of different widths with a narrower width portion downwardly extending from a wider width portion, the second magnet being recessed within the narrower width portion.

8. The stirrup according to claim 7, wherein said first magnet is integrated into a first contact surface of said second end portion of said tread, and said second magnet is integrated into a second contact surface of said second side branch, said first contact surface and said second contact surface having shapes that are complementary to one another, and the narrower width portion of the second side branch is tapered.

9. The stirrup according to claim 8, wherein said first contact surface and said second contact surface have shapes enabling said second contact surface to move relative to said first contact surface from said position for use in a plurality of directions.

10. A stirrup for horse-riding comprising:

(a) a tread a first end of which is connected by a first side branch to an upper portion adapted to receive a stirrup leather, a second side branch movable between a position for use in which said second side branch connects a second end portion of said tread to said upper portion and open positions in which said second side branch is distanced from said second end portion of said tread;

(b) a swivel linkage including:

(i) an elastic cord internally extending within said second side branch, said second side branch being connected to said upper portion by said elastic cord to allow pivoting of said second side branch relative to said upper portion in any direction without being constrained by an axis of rotation;

(ii) a centering stud projecting upwardly from an upper surface of said second side branch, said centering stud having a polygonal cross-section, and (iii) a recess defined in a surface of said upper portion, said recess having a complementary polygonal shape to that of said centering stud; wherein the swivel linkage is configured so that in said position for use, said elastic cord urges the centering stud into said recess; and (c) first and second magnets, said second end portion of said tread having said first magnet attached thereto, and said second side branch having said second magnet attached thereto, said first magnet and said second magnet being polarized so as to be rendered integral by magnetic attraction in said position for use of said second side branch, wherein in said position for use said second side branch is rendered integral with said second end portion of said tread by magnetic attraction.

11. The stirrup according to claim 10, wherein said first magnet is integrated and recessed into a first contact surface of said second end portion of said tread, and said second magnet is integrated and recessed into a second contact surface of said second side branch, said first contact surface and said second contact surface having shapes that are complementary to one another.

12. The stirrup according to claim 11, wherein said first contact surface and said second contact surface have shapes enabling said second contact surface to move relative to said first contact surface from said position for use in a plurality of directions.

13. The stirrup according to claim 10, wherein said elastic cord is secured internally inside said upper portion and secured internally inside said second side branch.

14. The stirrup according to claim 10, wherein said complementary polygonal shaped centering stud and recess are adapted to maintain said second side branch in said position for use, when said surfaces are in contact.

15. The stirrup according to claim 10, wherein said centering stud has a triangular cross-section.

16. A horse-riding stirrup comprising:

(a) an upper horse stirrup portion including an eye aperture;

(b) a tread located below and being spaced away from said eye aperture with a foot opening therebetween;

(c) an inner side branch rigidly affixed to said upper horse stirrup portion and said tread;

(d) a metallic outer side branch extending between said upper horse stirrup portion and said tread with said foot opening between said inner branch and said outer side branch, said outer side branch movable between a position for use in which said second sine branch connects a second end portion of said tread to said upper portion and open positions in which said second side branch is distanced from said second end portion of said tread;

(e) a joint always connecting an upper end of said outer side branch to said upper horse stirrup portion which allows said outer side branch to move fore-and-aft and outwardly relative to a remainder of said stirrup, while allowing a lower end of said outer side branch to move away from said tread, wherein said joint comprises:

(i) an elastic cord having a lower end internally fastened within said outer side branch and an upper end internally fastened within said upper horse stirrup portion, (ii) a centering stud having a non-circular cross-section and projecting from one of said upper or lower surfaces, wherein the other of said upper or lower surfaces has a recess of complementary non-circular shape to that of said centering stud; wherein said joint is configured so that in said position for use, said elastic cord urges said centering stud into said recess.

17. The stirrup according to claim 16, wherein said centering stud has a larger width than height and includes a central hole in a top thereof through which said elastic cord of said joint extends; and further comprising recessed magnets coupling said lower end of said outer side branch to said tread.

* * * * *